United States Patent [19]

de Boer et al.

[11] Patent Number: 4,651,667

[45] Date of Patent: Mar. 24, 1987

[54] ARTICULATED BARGE FOR TOWING AND LAUNCHING OFFSHORE STRUCTURES

[75] Inventors: Nico de Boer, Kenner; Stafford J. Menard, Houma, both of La.

[73] Assignee: McDermott International, Inc., New Orleans, La.

[21] Appl. No.: 775,113

[22] Filed: Sep. 11, 1985

Related U.S. Application Data

[63] Continuation-in-part of Ser. No. 562,559, Dec. 19, 1983, abandoned.

[51] Int. Cl.[4] ..... B63B 3/02

[52] U.S. Cl. ..... 114/77 A; 114/32; 405/209

[58] Field of Search ..... 114/26–30, 114/77 R, 77 A, 248, 249, 242, 352, 353

[56] References Cited

U.S. PATENT DOCUMENTS

| | | | |
|---|---|---|---|
| 2,711,148 | 6/1955 | Schmidt | 114/77 R |
| 3,054,267 | 9/1962 | Alcorn et al. | 114/29 |
| 3,370,564 | 2/1968 | Archer et al. | 114/77 R |
| 3,750,607 | 8/1973 | Seymour et al. | 114/242 |
| 3,799,101 | 3/1974 | Finefrock | 114/249 |
| 4,050,395 | 9/1977 | Anderson | 114/77 R |
| 4,135,842 | 1/1979 | Blight et al. | 405/209 |

*Primary Examiner*—Sherman D. Basinger
*Assistant Examiner*—Jesûs D. Sotelo
*Attorney, Agent, or Firm*—Robert J. Edwards; Michael L. Hoelter

[57] ABSTRACT

A variable capacity floating articulated barge assembly including two barges which are pivotally connected at their mating ends. An elongated structure to be launched is jacked to initiate it sliding along skidways on each barge toward one end region where a pivotal support member finally supports this structure prior to it being launched from this barge assembly. During launching the barges and the support member of this assembly pivot with respect to each other depending upon the degree and location of the load.

12 Claims, 19 Drawing Figures

ARTICULATED BARGE FOR TOWING AND LAUNCHING OFFSHORE STRUCTURES

This application is a continuation-in-part application of Ser. No. 562,559, filed Dec. 19, 1983, now abandoned.

FIELD OF THE INVENTION

The present invention relates to a barge for the transportation and/or launching of heavy structures such as an offshore oil drilling platform jacket and, more particularly, to an articulated barge and means for increasing the carrying and launching capacity of such a barge.

BACKGROUND OF THE INVENTION

The jacket of an offshore drilling platform is the elongated tubular lattice that extends from a base to the deck of the platform, encloses the conductor pipes, and to which deck modules are fitted. The jacket is prefabricated onshore and loaded aboard a launch barge on its side by sliding it along skid rails onshore and then onto skid rails on the deck of the barge.

The launch barge is typically a flat-bottomed and flat-decked barge having a large clear deck space for receiving the jacket. The jacket is temporarily welded to the barge with bracing material and then transported to the installation site. The launch barge is fitted with a tilting mechanism by means of which the jacket can be caused to slide into the water. At the installation site, the bracing is cut and jacks are employed to slide the jacket along the skid rails until its center of gravity is properly located relative to the tilting mechanism, and the jacket is then slid off the tilting mechanism into the water.

Launch barges must be skillfully designed to accomodate the significant loads imposed by the weight of the jacket, the launch stresses, and the normal forces encountered while the barge is underway. In order to increase the capacity of the launch barge so that it can carry greater structural weight, permanent alterations have had to be made to the barge. Such alterations include the permanent addition of sponsons, deck strapping, and additional barge length. The addition and removal of such additions is labor intensive, time consuming, and quite expensive.

It is an object of the invention to provide a variable capacity barge by the quick and inexpensive connection and disconnection of one or more barge extensions.

It is another object of this invention to provide a hinged or articulated barge to transport and launch large structures and one which transmits the sheer forces across the hinge but not the bending moments that are created as a consequence of the transporting and launching of these structures.

It is a further object of this invention to gravity launch large buoyant structures from a barge taking into consideration the position of the structures' center of gravity with respect to the barge.

A further object of this invention is to provide a barge and a launching mechanism capable of withstanding the large forces that develop during the launching operation.

SUMMARY

In accordance with the preferred embodiment, a towing and launching barge assembly includes first and second barges hinged or articulated together, the bow of one barge pivotally connected to the stern of another. Each of these barges have generally flat planar jacks with longitudinal skidways thereon. A support member is pivotally secured to the second barge in an end region opposite of the hinged connection with the first barge and this support member is aligned with the skidway. Jacking means are secured to this barge assembly for jacking an elongated structure with respect to this assembly for launching whereby this assembly pivots about its hinged connections during launching.

DETAILED DESCRIPTION OF THE DRAWINGS

Figure 1:
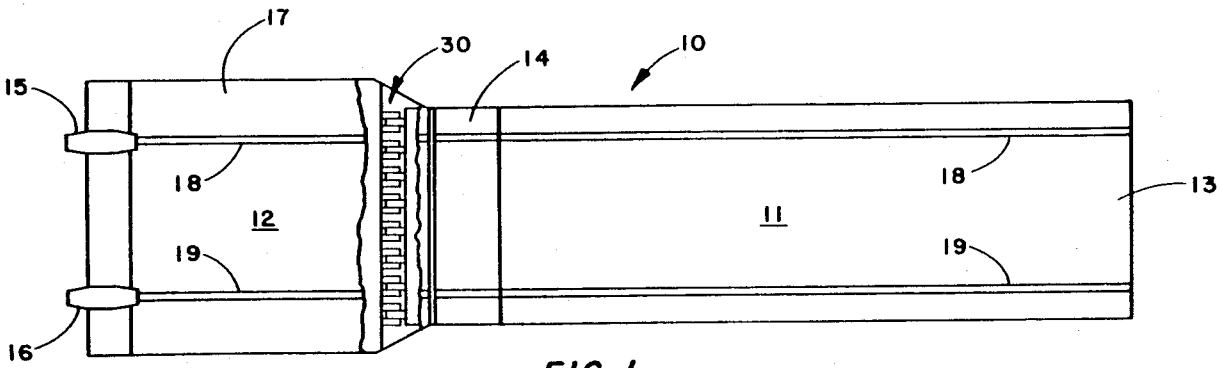
FIG. 1 is a partly broken-away, schematic plan view of a launch barge constructed in accordance with the invention.
Figure 2:
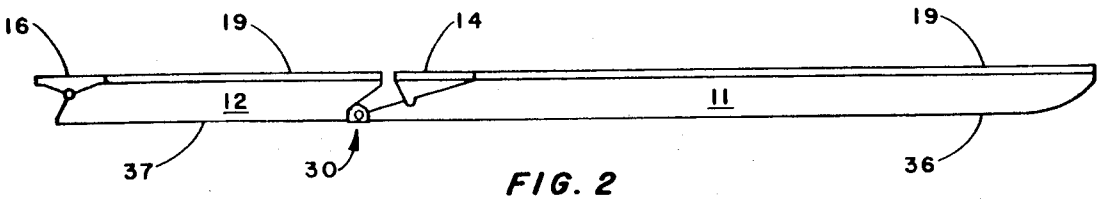
FIG. 2 is a side elevation view of the launch barge of FIG. 1.

Referring now to the drawings wherein reference numerals shown in the drawings designate like or corresponding parts throughout the same, there is shown in FIG. 1 a launch barge 10 for transporting and launching a prefabricated offshore structure such as a drill jacket (not shown).

The launch barge 10 is composed of two serially connected units, i.e., a secondary extension barge 12 which is releasably connected at its bow to a primary barge 11 at its stern in a manner described hereinafter.

The primary barge 11 is a conventional flat-bottomed and flat-decked barge modified by removal of the tilting mechanism, the so-called rocker arms, which generally are installed at one end of the barge for tilting and sliding the jacket from the deck 13 into the water. A launchway extension 14 is fixed to the end of the primary barge 11 in a stationary manner in lieu of the conventional rocker arms.

The secondary extension barge 12 is outfitted with a pair of rocker arms 15 and 16 mounted at the end of the deck 17 of the barge 12 which is remote from primary barge 11, that is, at its stern.

The launch barge 10 includes a pair of skid rails 18 and 19 mounted on and longitudinally extending along the length of each of the decks 13 and 17. The skid rails 18 and 19 provide means for sliding the jacket onto and off of the barge. The rocker arms 15 and 16 are longitudinally aligned with the skid rails 18 and 19 respectively.

Figure 3:
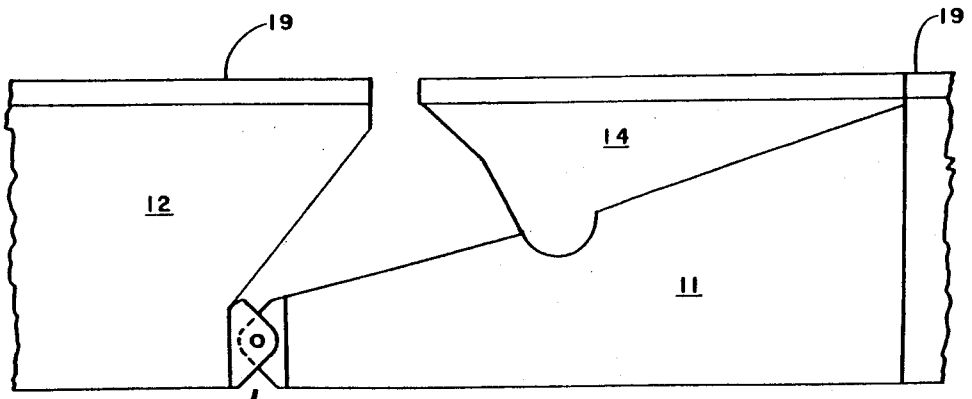
FIG. 3 is a partial elevational view showing the interconnection of two barges in accordance with the invention.

As best shown in FIG. 3, the upper portion of the bow of the secondary barge 12 overlies a lower portion of the stern of the primary barge 11. The length of the launchway extension 14 is truncated relative to the length of the rocker arm which it replaces so that it does not extend to, or beyond, the stern of the primary barge 11 and allows the bow of the secondary barge 12 to freely rotate through an arc on either side of the horizontal plane in which the decks normally extend without contacting the primary barge.

The primary barge 11 and the secondary barge 12 are releasably connected to each other at their mating ends by a series of integrally attached hinge assemblies 30 located at laterally spaced intervals along the mating ends.

Figure 5:
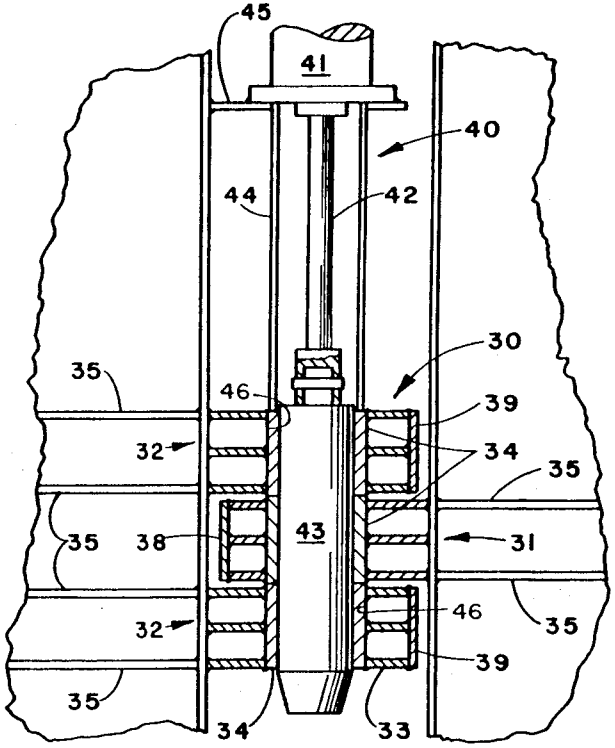
FIG. 5 is a view taken along lines 5—5 of FIG. 4.
Figure 4:
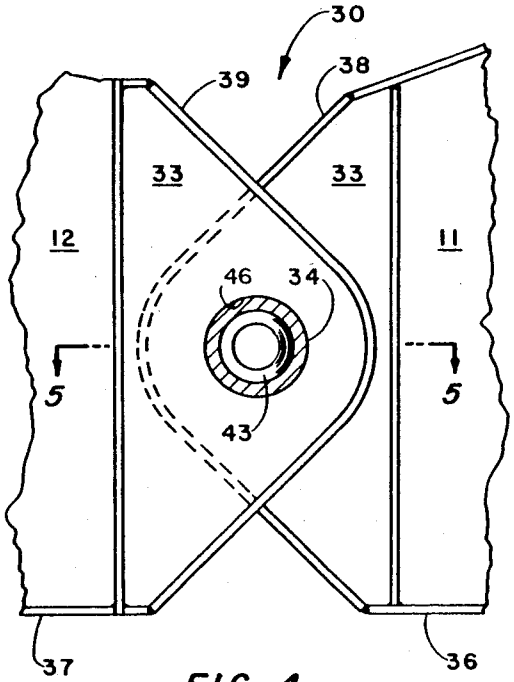
FIG. 4 is an enlarged elevation view showing the hinge assemblies according to the invention.

Each hinge assembly 30 includes groups of brackets designated herein as padeye assemblies 31 and 32. Padeye assembly 31 is connected to the mating end of the primary barge 11 and interleaved intermediate two laterally adjacent padeye assemblies 32 connected to the mating end of the secondary barge 12. Each of the padeye assemblies 31 and 32, as best shown in FIGS. 4 and 5, is composed of three vertically and longitudinally extending brackets 33 which are laterally spaced and interconnected by a heavy-walled pipe sleeve 34 extending through laterally aligned apertures 46 in each of the brackets 33. The pipe sleeve 34 is weldably fixed to each of the brackets 33 that comprises a respective one of the padeye assemblies 31 or 32. The three sleeves 34 of each hinge assembly 30 are axially alignable in an end to end mounting arrangement. The brackets 33 are preferably connected to and vertically extend from the bottom 36 and 37 of the respective barges 11 and 12 and are continuously vertically welded, at each side of one edge, along their length, and are spaced, at the opposite end, from the other barge when the barges are connected. An arcuate facing plate 38 and 39 overlies and interconnects an extreme edge of each of the brackets 33 of each respective padeye assembly 31 and 32. The laterally outermost brackets 33 of each assembly 31 and 32 are preferably aligned with bulkhead plates 35 of the respective barge to which the bracket is weld united in order to strengthen the connection with the respective barges 11 and 12.

The barges 11 and 12 are interconnected by hinge pins 43 inserted in the apertures 46 to permit relative rotational movement between these units in response to water undulations which may be attenuated by well known means of buoyancy control. It is envisioned that the provision of such rotational movement between the barges may allow a substantial reduction in the size of the rocker arms 15 and 16 although it may not be possible to eliminate the rocker arms altogether.

Each hinge assembly 30 includes a hydraulic actuator 40 comprising a cylinder 41 and a piston 42 integral with a piston (not shown) mounted slidably within the cylinder. The piston rod 42 is longitudinally connected to a hinge pin 43 which may be retractably extended through a tubular housing 44 connected in end to end relation to an adjacent one of the pipe sleeves 34. The piston rod 42 is designed for reciprocation of the hinge pin 43 axially into and out of the respective sleeves 34 of the padeye assemblies 31 and 32 of the respective hinge assembly 30. The hydraulic actuator 40 may be energized by well-known means. Thus, the actuator 40 is operable to connect and disconnect the barges 11 and 12 to and from each other by the respective insertion or extraction of the hinge pin into or out of all of the sleeves 34 of a group of padeye assemblies. The activator 40 is fixedly connected to the barge 12 via attachment with a mounting plate 45. However, it may alternatively be connected to the barge 11.

A launch barge 10 embodying the present invention may comprise a primary barge 11 of about 650 feet in length, with a beam of about 170 feet, connected to a secondary barge 12 of about 350 feet in length, with a launch end width of about 250 feet, the depth of each barge 11 and 12 being about 40 feet. The combined unit includes eight laterally spaced hinge assemblies each including 2 inch thick brackets having lengths of about 12 feet, sleeves each with an 18 inch outer diameter, a 12.25 inch inner diameter, and a length of 25 inches for accomodating a 12 inch outer diameter pin. Static calculations have indicated that such a combined flexible structure can accomodate a shear stress of about 35,700 kips (kilopounds) which is more than double the highest calculated shear load of about 17,000 kips for a 1,600 foot long, 75,000 ton jacket. A jacket of such size has not been built to date. 75,000 tons can be accomodated at a maximum draft of 19 feet. If the connection between the barges 11 and 12 were rigid, static calculations indicate that the moment at the connection would be 9,500,000 kip-ft., approximately twice the moment that such a conventional barge would be capable of handling. However, with the provision of the hinge assemblies 30, the extension barge 11 may rotate about the hinge pins 43 with the result that the moment at the hinges is, therefore, zero. Thus, the inventive arrangement is provided to increase the capacity of existing barges to allow launching of jackets larger than the original design capacity of the barge without extensive rebuilding and reinforcement of the barge. The inventive arrangement is provided to permit fast attachment and disengagement while allowing each barge of the dual unit to be separated and used as separate launch barges when not being used in combination for transporting and launching very large jackets.

The components of the hinge assemblies of the invention may be mounted to barges having various lengths so that different barges can be readily combined to obtain relatively larger or smaller overall lengths.

Figure 6:
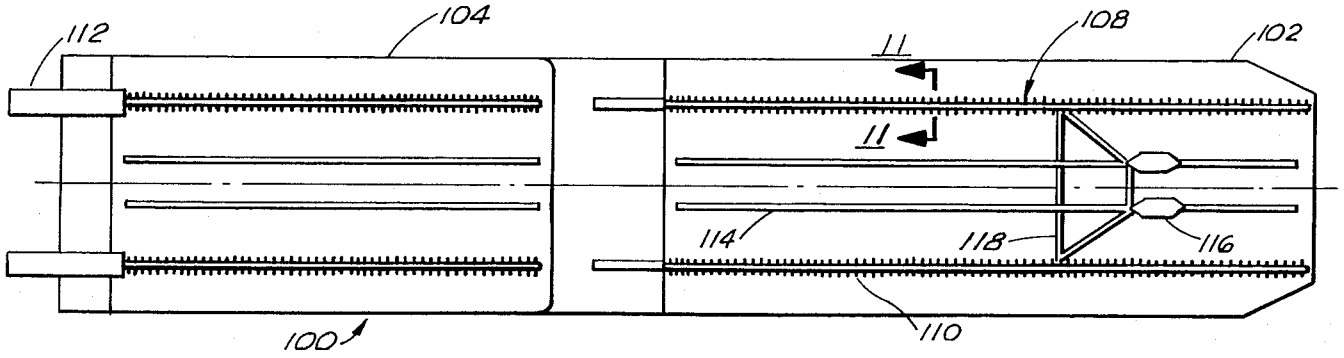
FIG. 6 is a schematic plan view of an alternative articulated barge.
Figure 7:
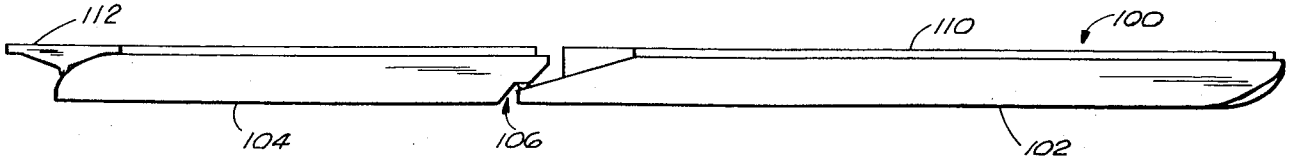
FIG. 7 is a side elevational view of the barge shown in FIG. 6.

Referring now to FIGS. 6 and 7, there is shown the preferred embodiment of alternative articulated towing and launching barge assembly 100 wherein main barge 102 and barge extension 104 are joined together by hinged connection 106 connecting the stern of main barge 102 to the bow of barge extension 104. Extending across the deck of barges 102 and 104 is skidway 108 which, due to barges 102 and 104 being articulated or hinged together, does not extend across hinged connection 106. Skidway 108 comprises a pair of elevated guides 110 which support the structure that is to be launched from articulated barge 100. Aligned with skidway 108 are rocker arms 112 pivotally secured to the stern of barge extension 104. As shown, the upper surface of rocker arms 112 is flushed with the top of guide 110 to enable the structure to freely slide along skidway 108. Between guides 110 are rails 114 which, extend along a portion of barges 102 and 104. Rails 114 support jacks 116 which jack the structure along guide 110 until the structure begins to slide along skidway 108 under its own weight as will be subsequently explained.

Jacks 116 include a jacking frame 118 that extends from rails 114 to guides 110. Jacking frame 118 is moved along rails 114 via front and back calipers (not shown) secured to each rail 114. These calipers alternatively tighten and release their grip on rails 114 enabling a hydraulic cylinder connecting them to alternately bring them together or move them apart thereby incrementally moving jacking frame 118 along rails 114. These calipers are also operated by hyraulic cylinders due to the large forces required to push or jack the structure along skidway 108.

Rails 114 extend across a portion of barges 102 and 104 and a rail extension (not shown) can be fitted across hinged connection 106 to connect these rails together. Additionally, jacks 116 may be moved adjacent rocker arm 112 and jacked toward the bow of main barge 102 to aid in loading a large structure onto articulated barge 100.

Figure 8:
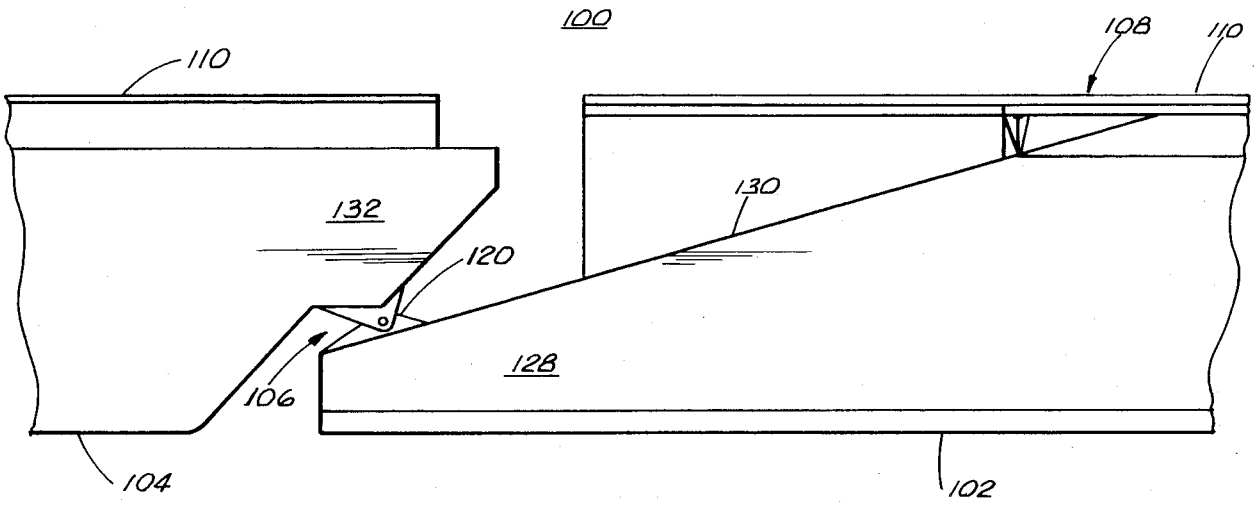
FIG. 8 is an elevational view, partially broken away, illustrating the hinged connection between the two barges shown in FIG. 6.
Figure 9:
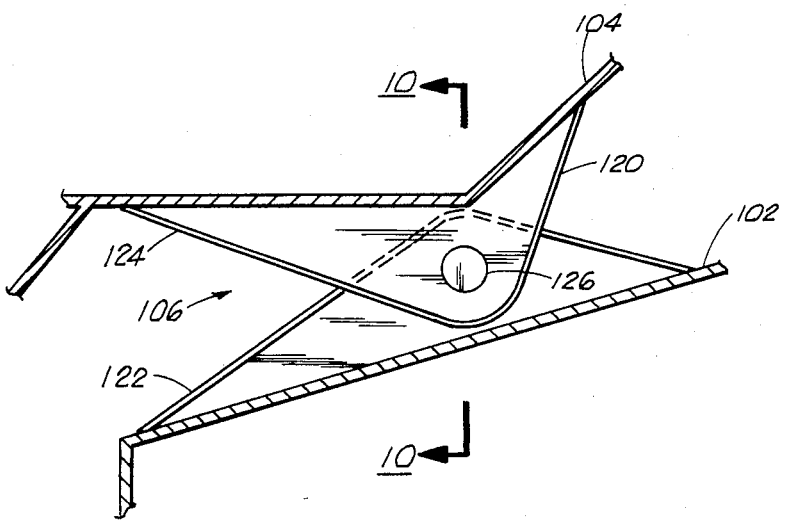
FIG. 9 is a detailed view, partially broken away, of the hinged connection between the main barge and the barge extension.
Figure 10:
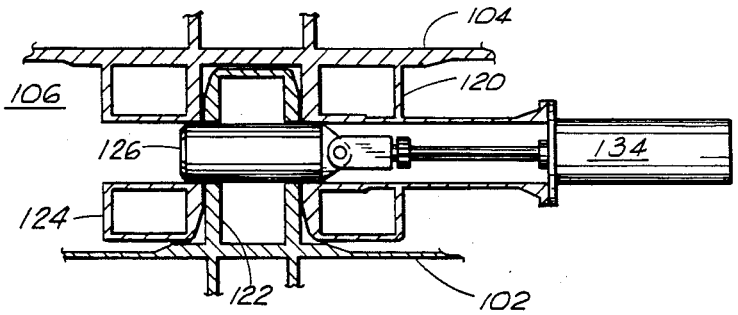
FIG. 10 is a sectional view, partially broken away, taken along lines 10—10 of FIG. 9.

Referring now also to FIGS. 8 through 10, hinge 120 is secured intermediate the deck and the bottom surface of barges 102 and 104, and hinge 120 consists of a series of brackets 122 and 124 each fixedly secured to one of barges 102 and 104 respectively, that pivot about end 126. As illustrated, bracket 124 is secured to rearward or stern projection 128 of main barge 102 and this projection has an upper surface 130 that is tapered with respect to the deck of main barge 102. For extension barge 104, bracket 124 is secured to an underneath side of bow extension 132. Similar to pin 43, pin 126 is removably retreived from brackets 122 and 124 by cylinder 134 to enable barges 102 and 104 to be connected or disconnected as desired. Hinged connection 106 between barges 102 and 104 comprises a multitude of hinges 120, a total of approximately 14, which are spaced across the width of these barges.

Due to the articulated or hinged connection 106 between barges 102 and 104, the shear forces due to the loading, transporting and launching of the large structure is transferable across connection 106 but the vast bending moments associated with such loads is not able to be so transmitted. Thus, articulated barge 100 need not be constructed so as to withstand such large bending moments which reduces the depth and construction costs of this barge. For example, for a platform support jacket having a length of approximately 1,500 feet, the length of main barge 102 might be in the range of approximately 650 feet while barge extension 104 might have a length in the range of approximately 400 feet with each barge having a depth of approximately 40 feet. In contrast, were a single barge having the same overall length as barges 102 and 104 constructed to support, transport, and launch the same jacket, its depth would be approximately 55 feet—a considerable difference for barges—due to the tremendous bending moment forces near the middle of the barge.

Figure 11:
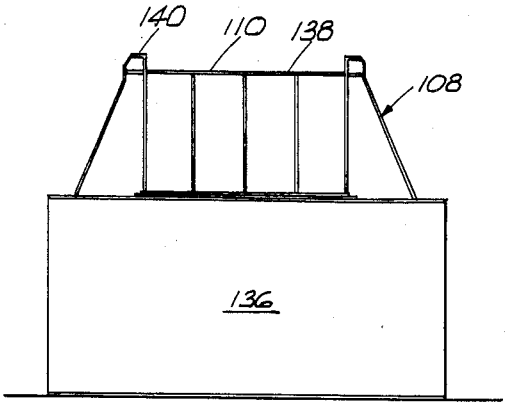
FIG. 11 is a sectional view, partially broken away, taken along lines 11—11 of FIG. 6.

Referring now to FIG. 11, there is shown one of guides 110 of skidway 108. Guide 110 is supported on support member 136 above the deck of barges 102 and 104 and support member 136 is generally a structural member oriented transverse to elongated guide 110 and spaced approximately 45 feet to 120 feet on center along each guide 110. The upper surface 138 of guides 110 are configured smooth and are generally coated with teflon or other slippery substance to enhance the sliding of the structure along skidway 108. Shoulders 140 on opposite sides of upper surface 138 of guides 110 assist in retaining the structure on guides 110.

Figure 12:
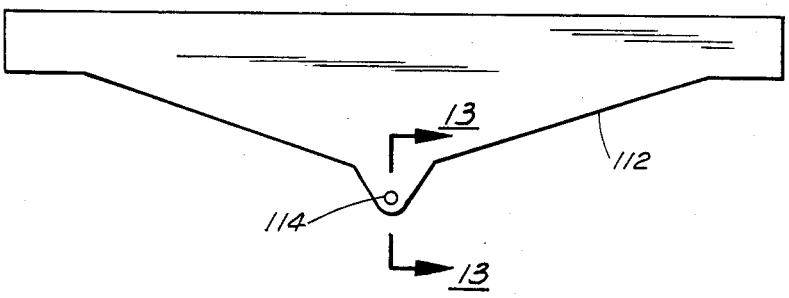
FIG. 12 is a side elevational view of a rocker arm.
Figure 13:
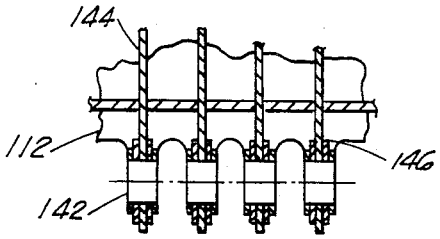
FIG. 13 is a sectional view, partially broken away, taken along lines 13—13 of FIG. 12.

Referring now to FIGS. 12 and 13, rocker arm 112 is shown which is pivotally secured to the stern of barge extension 104. Rocker arm 112 pivots about a pin (not shown) which extends through opening 142. This pivotal connection enables rocker arm 112 to freely pivot at least approximately 90 degrees or as required during the launching operation. Interior of rocker arm 112 are stiffeners 144 which brace and support rocker arm 112 and through which pin opening 142 extends. As shown, stiffeners 144 are reinforced by plates 146 surrounding opening 142 to provide additional strength and durability.

Figure 14:
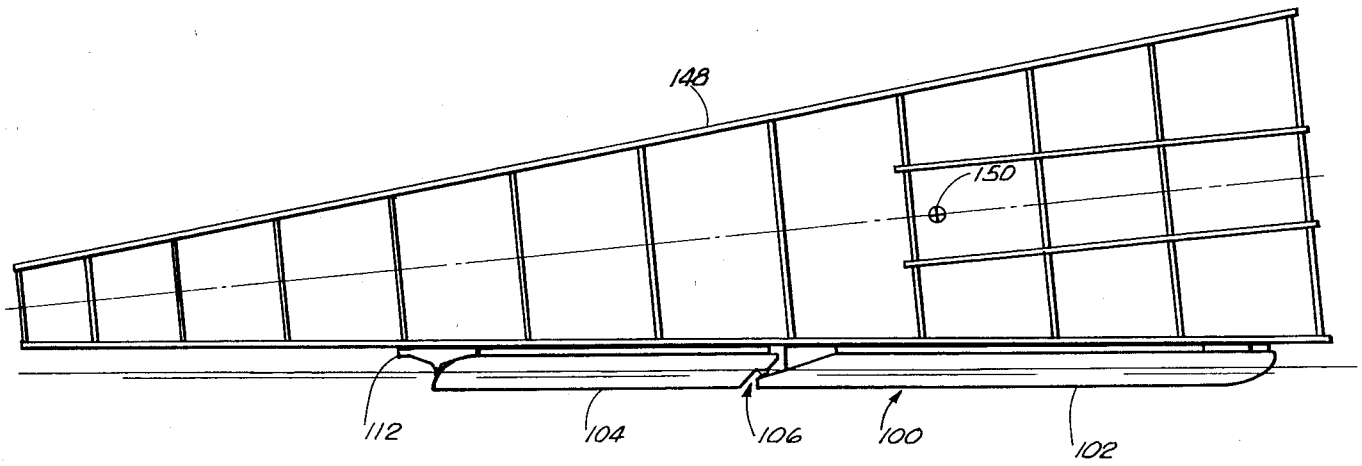
FIG. 14 is a side elevational view illustrating the relative position of the jacket on the barge as it is being towed.

Referring now to FIGS. 14 through 18, there is shown the sequence of launching jacket 148 from articulated barge 100. Preferably, as shown in FIG. 14, jacket 148 is loaded and secured onto articulated barge 100 with the center of gravity 150 of jacket 148 positioned over main barge 102 and with a portion of jacket 148 extending rearward beyond barge extension 104. Jacket 148 and articulated barge 100 are then towed out to the desired location after which jacket 148 is unsecured from articulated barge 100 and jacked along skidway 108 by jacks 116. It should be noted that jacket 148 is constructed of hollow tubular members that are sealed to be water tight but which may be selectively unsealed to control the buoyancy force of this jacket. Consequently, during launching, all the members are sealed so as to provide a maximum buoyant force during unloading. In some, if not all cases, jacket 148 will float once it is fully unloaded with certain member sections being subsequently flooded to finally position the jacket where desired.

Figure 15:
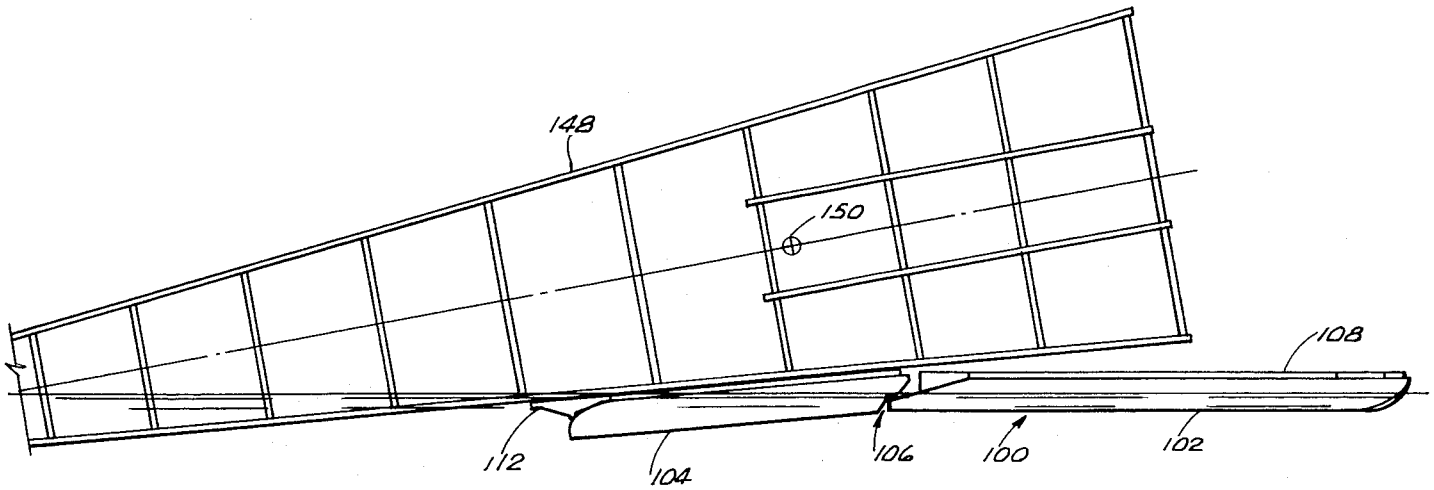
FIG. 15 is a side elevational view, partially broken away, illustrating the relative position of the jacket with respect to the barge after initial jacking.
Figure 16:
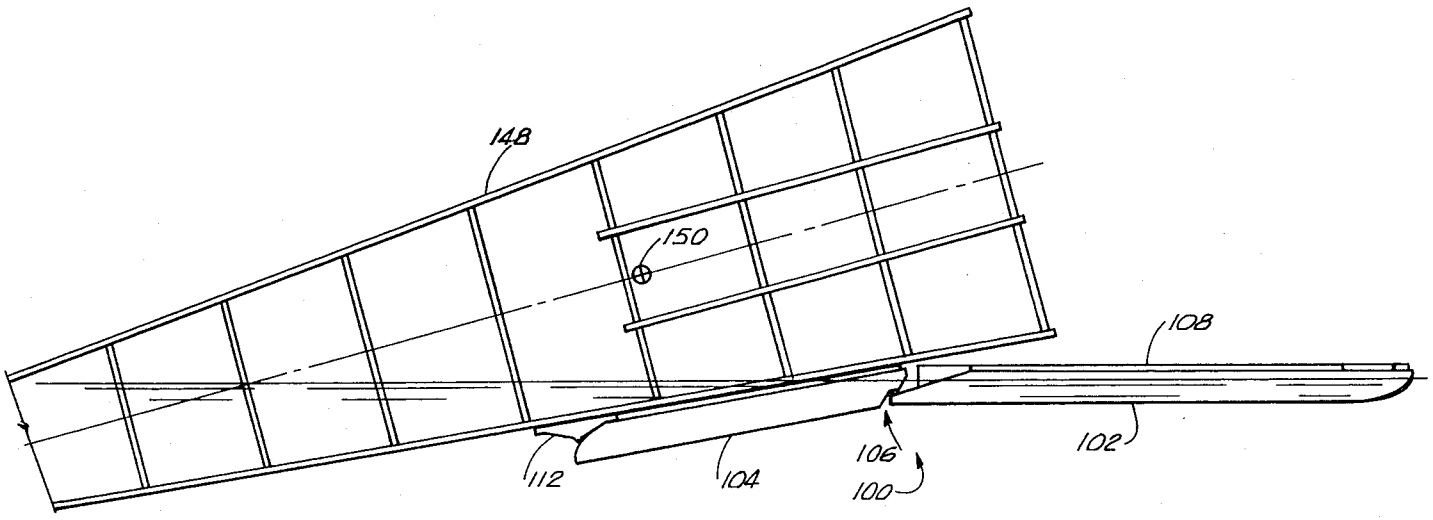
FIG. 16 is a side elevational view, partially broken away, illustrating the relative position of the jacket with respect to the barge after the jacket begins to slide off the barge.

The jacking operation continues until jacket 148 is moved along articulated barge 100 such that jacket 148 begins to slide off barge 100 due to gravity (see FIG. 15). This usually occurs when the center of gravity 150 of jacket 148 approaches or passes over hinged connection 106. As jacket 148 slides along skidway 108, barge extension 104 pivots with respect to main barge 102 as a result of the load being transferred to barge extension 104. As shown is FIG. 16, barge extension 104 becomes partially or fully submerged during this launching operation and especially when the center of gravity 150 of jacket 148 passes across hinged connection 106. As indicated earlier, the buoyancy force of jacket 148 helps support jacket 148 during the launching operation.

Figure 17:
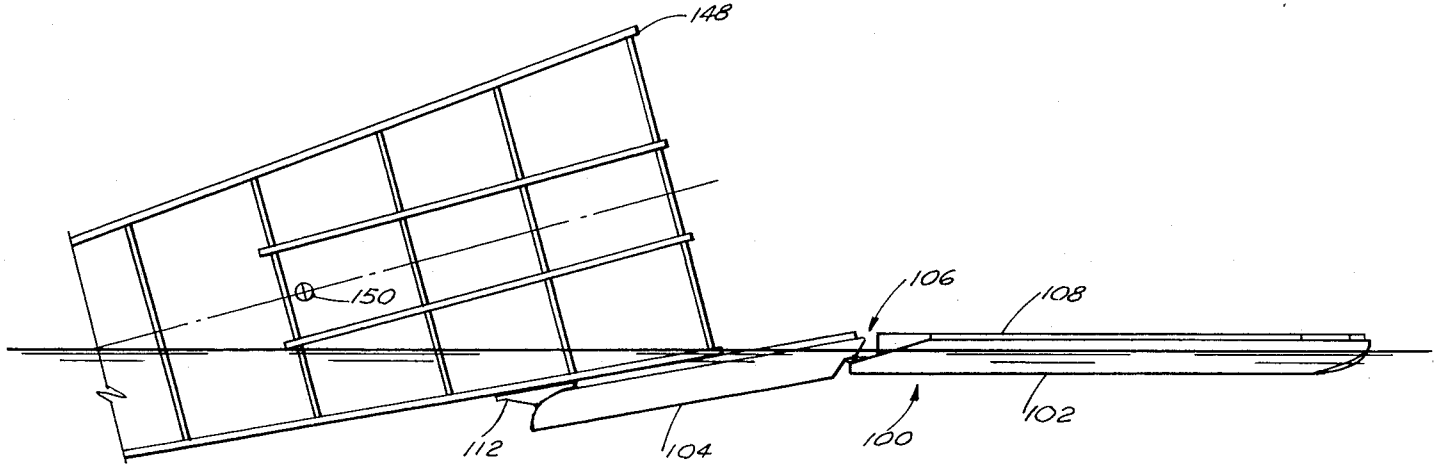
FIG. 17 is a side elevational view, partially broken away, illustrating the relative position of the jacket with respect to the barge as the jacket slides along the rocker arm.
Figure 18:
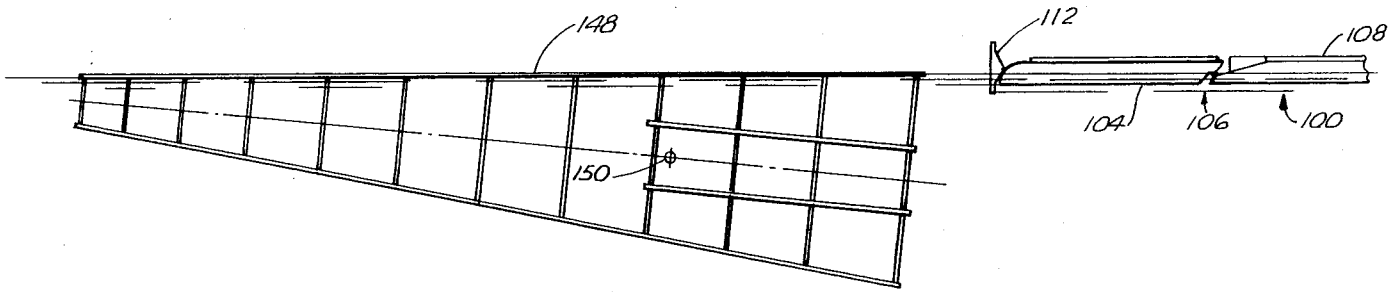
FIG. 18 is a side elevational view, partially broken away, illustrating the jacket after being launched and floating in a horizontal position.
Figure 19:
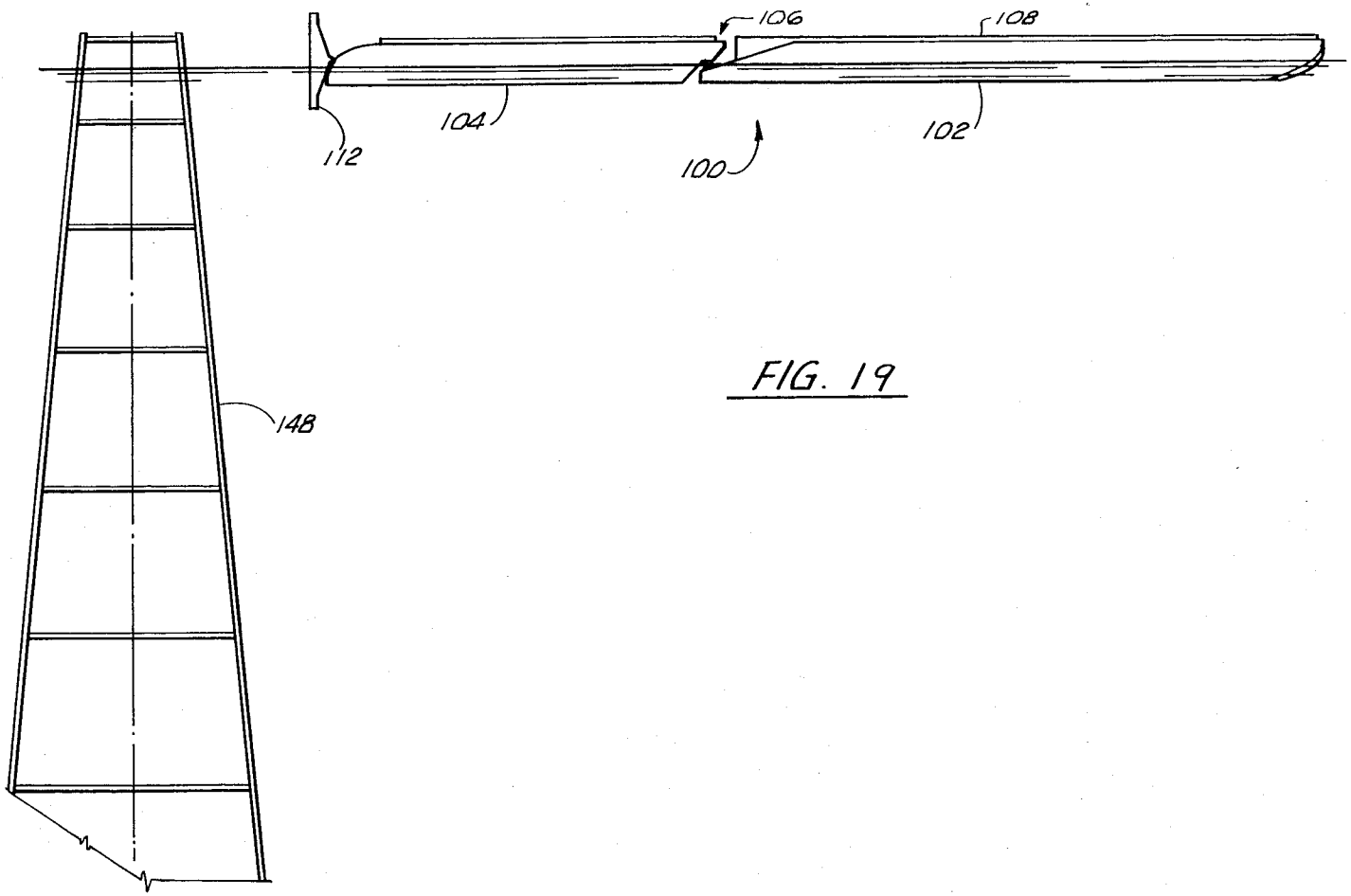
FIG. 19 is a side elevational view, partially broken away illustrating the jacket positioned in an upright manner.

Referring now to FIG. 17, the center of gravity 150 of jacket 148 has passed across rocker arm 112 causing them to pivot to further support jacket 148 prior to it being released. Gradually, depending on the speed at which jacked 148 slides off articulated barge 100, the support of jacket 148 comes from its own buoyancy rather than from barge 100. As the launch progresses, it can be seen from FIG. 17 that barge extension 104 is pivoted with respect to main barge 102 and, additionally, rocker arms 112 are pivoted with respect to barge extension 104. This continues until jacket 148 is fully launched (FIG. 18) after which articulated barge 100 once again floats on the surface of the water. Generally at this time jacket 148 is floating on its side but as indicated earlier, certain segments of its tubular construction can be flooded thereby shifting its center of gravity 150 and altering its buoyancy force enabling it to be secured to the sea bed as desired (FIG. 19). This operation of altering the buoyancy force of jacket 148 is separate from the operation of launching jacket 148 and articulated barge 100 is concerned only with the launching of this jacket. After launching, articulated barge 100 is towed back to shore where barge extension 104 is disconnected from main barge 102 if desired.

As can be seen, should jacket 148 (or for that matter any structure being towed) be considerably longer than the combination of main barge 102 and extension barge 104, additional extension barges may be secured to articulated barge 100 in a similar manner as barges 102 and 104 are secured together until the length of these barges is sufficient to accommodate the length of the vessel being towed. Also during loading and towing, the towed structure, in this case jacket 148, acts as a stiffener for these pivotally connected barges keeping them aligned with respect to each other.

While specific embodiments of the invention have been shown and are described in detail to illustrate the application of the principals of the invention, it will be understood that the invention may be embodied otherwise without departing from such principals.

What is claimed is:

1. An articulated barge for towing and launching elongated structures comprising:

a first elongated barge having a first mating region and a relatively flat planar deck;

a second elongated barge having a second mating region configured to mate with said first mating region and having a relatively flat planar deck;

connecting means for pivotally connecting said first and second mating regions;

a longitudinal skidway secured to said decks of said first and second barges;

a support member pivotally secured to said second barge opposite said second mating region, said support member being in longitudinal alignment with said skidway; and, jacking means for jacking said elongated structure with respect to said articulated barge whereby said second barge is pivotal with respect to said first barge and said support member is pivotal with respect to said second barge.

2. An articulated barge as set forth in claim 1 wherein said skidway comprises at least two guides having slick upper surfaces.

3. An articulated barge as set forth in claim 2 wherein said guides are parallel.

4. An articulated barge as set forth in claim 3 wherein said guides extend across a portion of said decks of said first and second barges.

5. An articulated barge as set forth in claim 4 wherein said support member comprises at least two rocker arms in longitudinal alignment with said guides.

6. An articulated barge as set forth in claim 5 wherein said rocker arms are pivotal at least 60 degrees with respect to said second barge.

7. An articulated barge as set forth in claim 5 wherein said guides and a portion of said rocker arms are elevated above said decks of said first and second barges.

8. An articulated barge as set forth in claim 7 wherein said jacking means includes at least one rail secured to said first barge for jacking said structure along said first barge.

9. An articulated barge as set forth in claim 8 wherein said connecting means include a plurality of spaced hinges pivotally connecting said first barge with said second barge and wherein each said hinge comprises a removable pin.

10. An articulated barge as set forth in claim 7 wherein said jacking means includes at least one rail secured to said second barge for jacking said structure along said second barge.

11. An articulated barge as set forth in claim 10 wherein said connecting means include a plurality of spaced hinges pivotally connecting said first barge with said second barge and wherein each said hinge comprises a removable pin.

12. The method of towing and launching an elongated structure comprising the steps of:

loading said structure onto an elongated articulated barge assembly having at least one pivotal support member secured to a longitudinal end region of said assembly;

supporting said structure on skidways secured to said articulated barge assembly, said skidways extending longitudinally from said pivotal member;

transporting said barge assembly and structure to a predetermined area;

jacking said structure with respect to said articulated barge assembly; and, sliding said structure along said skidway toward said pivotal member.

* * * * *